United States Patent [19]

Heimann

[11] Patent Number: 4,557,428

[45] Date of Patent: Dec. 10, 1985

[54] WIRE LAYING ARM

[75] Inventor: Bernhard Heimann, Essen, Fed. Rep. of Germany

[73] Assignee: Fried. Krupp Gesellschaft mit beschränkter Haftung, Essen, Fed. Rep. of Germany

[21] Appl. No.: 637,225

[22] PCT Filed: Nov. 26, 1983

[86] PCT No.: PCT/EP83/00317

§ 371 Date: Jul. 26, 1984

§ 102(e) Date: Jul. 26, 1984

[87] PCT Pub. No.: WO84/02294

PCT Pub. Date: Jun. 21, 1984

[30] Foreign Application Priority Data

Dec. 15, 1982 [DE] Fed. Rep. of Germany ..... 3246420

[51] Int. Cl.[4] ..... B21C 47/00

[52] U.S. Cl. ..... 242/82

[58] Field of Search ..... 242/82, 83, 47.01, 47.12, 242/47, 128; 254/382, 394, 400; 19/159 R, 159 A; 72/142-146, 148, 135

[56] References Cited

U.S. PATENT DOCUMENTS

| | | | |
|---|---|---|---|
| 694,003 | 2/1902 | DeLamater . | |
| 2,723,525 | 11/1955 | Blaisdell | 57/58.36 |
| 2,868,265 | 1/1959 | Williams | 153/54 |
| 3,097,812 | 7/1963 | Nye et al. | 242/82 |
| 3,282,304 | 11/1966 | Coleman | 140/147 |
| 4,189,106 | 2/1980 | Weis | 242/82 |
| 4,332,155 | 6/1982 | Pariseau | 72/66 |

FOREIGN PATENT DOCUMENTS

| | | | |
|---|---|---|---|
| 577699 | 6/1933 | Fed. Rep. of Germany . | |
| 1499041 | 10/1969 | Fed. Rep. of Germany . | |
| 2039572 | 2/1972 | Fed. Rep. of Germany . | |
| 2414015 | 10/1974 | Fed. Rep. of Germany . | |
| 2737712 | 3/1978 | Fed. Rep. of Germany | 242/83 |
| 1341651 | 9/1963 | France . | |
| 1433701 | 2/1967 | France . | |
| 1132609 | 11/1968 | United Kingdom . | |

*Primary Examiner*—John M. Jillions

*Attorney, Agent, or Firm*—Spencer & Frank

[57] ABSTRACT

In a wire laying arm (1) provided with a roller guide for the wire wherein the roller guide is curved along a curve in space and is formed by a plurality of profiled rollers (4) arranged at the laying arm (1), versatile use and long service life are realized in that the rollers (4) are arranged individually and at a distance from one another at the convex side of the curve in space, each approximately at the location where the curve in space has its greatest curvature in the roller arrangement. The laying arm (1) is here preferably designed as a tube provided with recesses into which the profiles of the rollers (4) engage to the extent at least that the wire is spaced from the tube wall at least in the region of the recesses to both sides of the rollers (4).

5 Claims, 4 Drawing Figures

WIRE LAYING ARM

BACKGROUND OF THE INVENTION

The invention relates to a wire laying arm provided with a roller guide for the wire, wherein the roller guide is curved along a curve in space and is formed by a plurality of profiled rollers disposed at the laying arm. A wire laying arm of this type is known from DE-PS No. 2,814,143. This laying arm has two rows of profiled rollers which are arranged successively in each row so that they form the only guide means for the wire which moves between the two rows. This laying arm is complicated and additionally has the drawback that, due to differences in load, the rollers exhibit different degrees of wear.

SUMMARY OF THE INVENTION

The invention is based on the problem of providing a wire laying arm of the above-mentioned type which permits, at relatively little expense, accurate and low-wear wire guidance. The problem is solved, according to the invention by the provision of a wire laying arm composed of roller guides formed by a plurality of rollers which are individually mounted and are spaced from one another along the convex side of a curve, each roller being disposed at a location where, in the roller arrangement, the curve has its greatest curvature.

The invention brings the advantage that exclusively a rolling friction is produced with a small number of rollers. Nevertheless, the novel laying arm is suitable not only for laying thin wires but particularly also for laying thicker wires, even those exceeding known rolled wire thicknesses. And it is possible to adapt the roller diameter to different respective loads and conditions.

It is further possible to vary the distance between the individual rollers. It is here of particular advantage that this distance is less in the regions of greater curvature of the curve in space than in the other regions, thus improving the guiding effect.

For threading the wire, it is advisable to place guide elements for the wire between the rollers at the convex side of the curve in space at a distance therefrom so that the guide elements extend close to the rollers. This, moreover, provides additional security against the wire popping out.

The same is accomplished by the fact that the laying arm is designed as a tube, with the tube being provided with recesses into which the profiles of the rollers engage at least to the extent that, at least in the region of each recess, the wire is spaced from the tube wall to both sides of the associated roller. This configuration of the laying arm permits a particularly simple, expedient and safe design which also makes possible an exchange of such a laying arm for one of the laying tubes which are frequently used in existing systems and which, due to the strong friction against the tube wall, encountered therein are subject to rapid wear.

BRIEF DESCRIPTION OF THE DRAWING

In the drawings, which will be explained in greater detail below, two embodiments of the invention are represented schematically.

DESCRIPTION OF THE PREFERRED EMBODIMENTS

Figure 1:
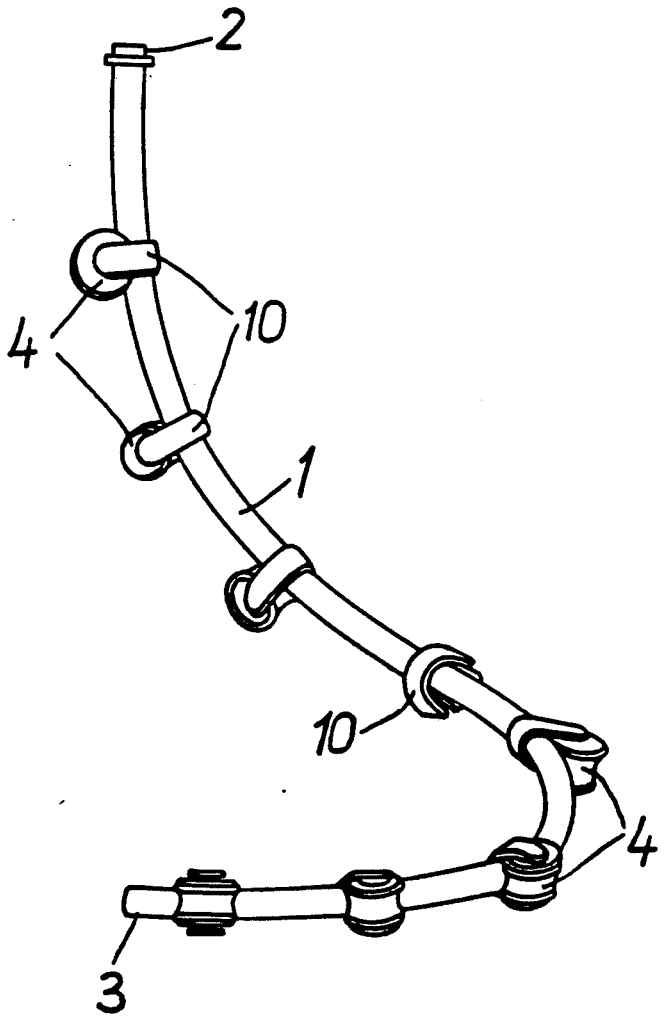
FIG. 1 is a front elevational view of a laying arm designed as a tube.

Referring to FIG. 1, the tube-shaped installation arm 1 of a wire reel (not shown) receives the drawn wire coming from a rolling mill at its upper end 2 which is rotatably mounted at the wire reel and, in the course of the curve in space, shapes the wire into endless coils which exit at the lower end 3 of the arm.

Figure 2:
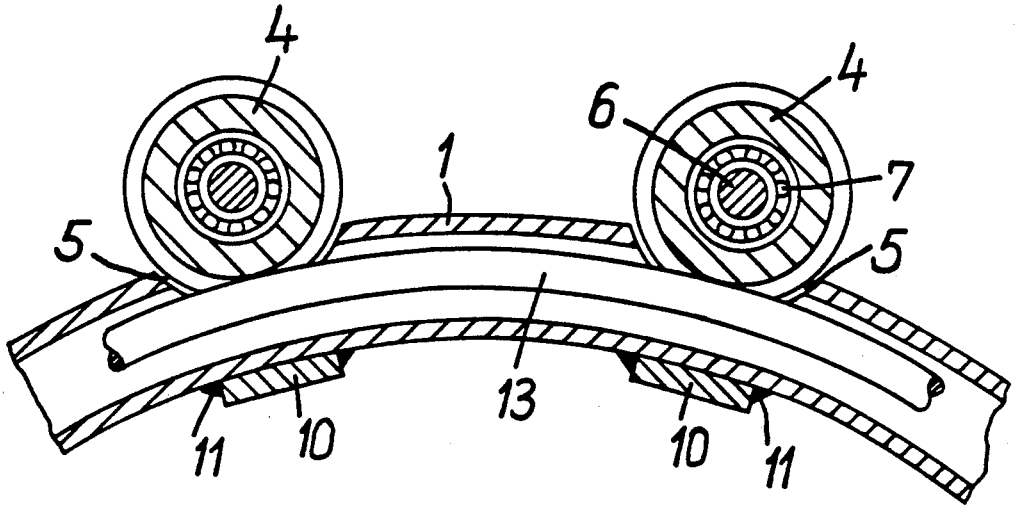
FIG. 2 is a longitudinal cross-sectional view of part of the laying arm of FIG. 1.
Figure 3:
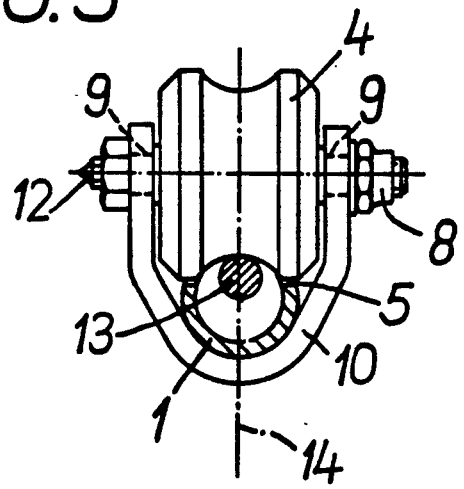
FIG. 3 is a cross-sectional view of the laying arm in the form of a tube in the region of a roller.

As is evident from FIG. 1, eight profiled rollers 4 are arranged at laying tube 1, which has an inner diameter of 40 mm, so as to be distributed over the length of the tube; the rollers are spaced apart between 250 and 300 mm from center to center, with the smaller spacing here being applicable to the region of the laying tube in which it has the greatest curvature. At its convex side, in the region of the rollers, laying tube 1 is provided with recesses 5 in which rollers 4 engage with play as shown in FIGS. 2 and 3. The laid wire 13 is a steel wire having a diameter of 22 mm.

Rollers 4 are each mounted on a respective shaft 6 by means of encapsulated ball bearings 7, and can thus be exchanged easily in that shaft 6 is designed as a plug-in shaft and is fastened by means of nuts 8. The fastening is supported on each side by the arms of a U-shaped clamp 10 which encloses laying tube 1 and is fastened to the latter by means of weld beads 11. Each U-shaped arm is provided with a bore 9.

Ball bearings 7 are lubricated centrally through corresponding channels in shaft 6 and by way of a lubricating nipple 12. Wire 13 is cooled to the required extent by spray nozzles (not shown) which spray the coolant into recesses 5 in the direction of movement of wire 13 next to rollers 4.

During its passage through laying arm 1, wire 13, as shown in FIG. 2, is supported only by rollers 4. The tube 1 constituting the laying arm, serves merely to support rollers 4 and simultaneously to securely shield the wire and possibly to conduct the coolant. In a known manner, the tube may be bent following an existing pattern so as to conform to the intended curve in space. Recesses 5 are then cut out at the locations intended for rollers 4 and then the clamps 10 for rollers 4 are initially only clamped on. Then clamps 10 are aligned in such a manner that the curvature normal 14 is perpendicular to the axis of rotation of rollers 4, as indicated in FIG. 3. This meets the requirement that rollers 4 be arranged where the curve in space has the greatest curvature at that particular location. The result is that ball bearings 7 are stressed only radially and thus have a longer service life. The number and size of rollers 4 depend on the respective loads resulting from the thickness and rate of movement of the respective wire.

After alignment of clamps 10, the latter are welded to laying arm 1. In special cases, it may be of advantage for rollers 4 to be adjustable in position at a later time. In that case, the respective clamp 10 is fastened to laying arm 1 in an adjustable manner, which can be done most easily by providing at least one fastening screw anchored in laying tube 1 which passes through a long hole provided in clamp 10.

Figure 4:
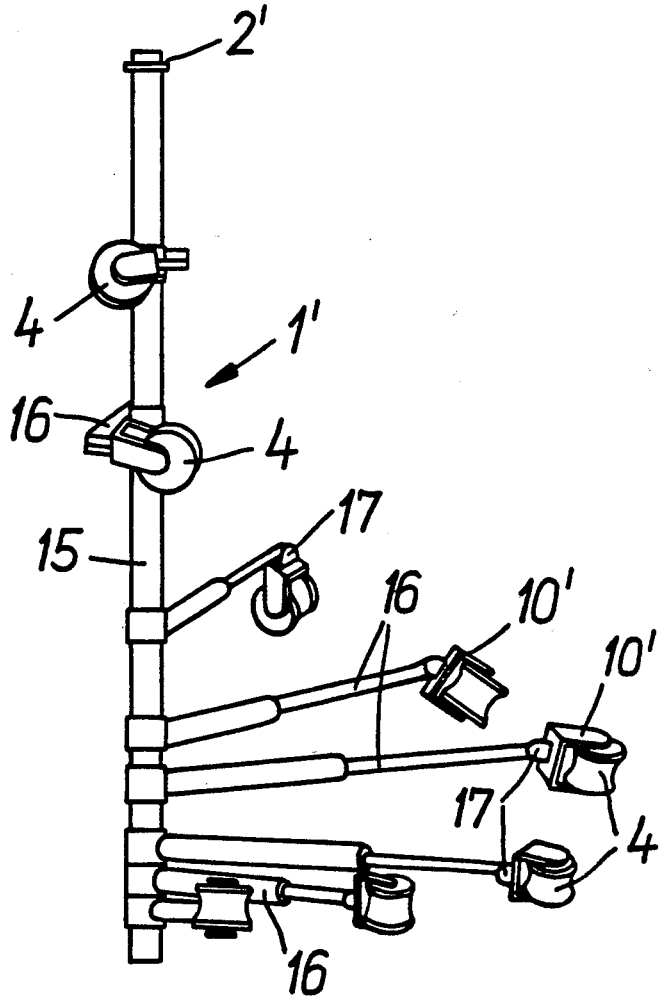
FIG. 4 is a front elevational view of another embodiment of the laying arm according to the invention.

In the other embodiment of the invention shown in FIG. 4, laying arm 1' is comprised of a tube 15 whose upper end 2' is rotatably connected to the wire reel and extends in a straight line. Arms 16 which are adjustable in length are pivotally fastened to tube 15. The free end of each arm 16 is provided with a U-shaped clamp 10' for supporting a respective roller 4. Clamps 10' are connected with arms 16 by way of respective joints 17 so that roller each 4 can be set in any desired direction. First, however, the desired curve in space must be determined by appropriately pivoting and adjusting the height and length of, arm 16. To be better able to thread the wire at the start of laying, it is advisable to provide metal guide sheets between rollers 4, with such sheets being arranged at the convex side of the curve in space and at a distance therefrom so that they extend close to the rollers, as is the case, for example, in the preceding embodiment for the outer tubular members of laying arm 1. The metal guide sheets are fastened to clamps 10' and simultaneously serve to stabilize laying arm 1'. The embodiment according to FIG. 4 has the advantage that the laying arm can easily be adapted to various curves in space.

I claim:

1. Wire laying device comprising:

a laying arm composed of a tube having a tube wall and having an upstream end at which a wire is introduced into said tube and a downstream end at which the wire exits from said tube, said tube being formed to follow a curved path having the form of a three-dimensional spiral between said upstream and downstream ends, said curved path having, at each point therealong, a curvature lying in a given plane and having a given center of curvature, said tube having a plurality of recesses spaced apart along the curved path; and a roller guide for guiding a wire which is being advanced through said tube, said guide comprising a plurality of profiled rollers supported by said tube and spaced apart along said curved path, each said roller having an axis of rotation and being mounted so that its profile extends into a respective recess to the extent that, at least in the region of each said respective recess, a wire located within said tube is spaced from said tube wall at locations spaced from the associated roller along said curved path toward both ends of said tube;

wherein each said roller is mounted individually so that only one said roller is disposed at a respective point along said curved path, each said roller is disposed at the side of said curved path which is directed away from the given center of curvature of the respective point along said curved path, and each said roller has its axis of rotation oriented perpendicular to the given plane of curvature at the respective point of curvature of said curved path.

2. Laying device according to claim 1 wherein said roller guide comprises, for each said roller, a shaft on which said roller is rotatably mounted, and a clamp provided with bores in which said shaft is mounted, said clamp being carried by and surrounding said tube.

3. Laying device according to claim 1, characterized in that the distance between the rollers is less in regions of greater curvature of said curved path than in the other regions.

4. Laying device according to claim 1, characterized in that the center to center spacing between said rollers is between ten and twenty times the wire diameter.

5. Laying arm according to claim 1, characterized in that the rollers are mounted to be adjusted so as to vary their position.

* * * * *